US005588778A

United States Patent [19]

Nichols et al.

[11] Patent Number: 5,588,778

[45] Date of Patent: Dec. 31, 1996

[54] LEACHING CHAMBER WITH ANGLED END

[75] Inventors: James M. Nichols, Old Saybrook; Bryan A. Coppes, Clinton, both of Conn.

[73] Assignee: Infiltrator Systems Inc., Old Saybrook, Conn.

[21] Appl. No.: 444,388

[22] Filed: May 19, 1995

[51] Int. Cl.[6] ..... E02B 13/00

[52] U.S. Cl. ..... 405/48; 405/49

[58] Field of Search ..... 405/36, 43, 44, 405/45, 46, 47, 48, 49, 51; 285/284

[56] References Cited

U.S. PATENT DOCUMENTS 4,759,661 7/1988 May et al. ..... 405/48
5,156,488 10/1992 Nichols ..... 405/48
5,215,338 6/1993 Kimura et al. ..... 285/184 X
5,401,459 3/1995 Nichols et al. ..... 264/572
5,409,266 4/1995 Baker ..... 285/184 X

*Primary Examiner*—William P. Neuder
*Attorney, Agent, or Firm*—C. G. Nessler

[57] ABSTRACT

A leaching chamber for gathering and dispersing liquids in soil has an end with an angled terminus, so that chambers may be connected as a string in a rough curve. An angled chamber end is severable from the chamber at an indicant, to convert the chamber to one having a different angled end, e.g., a square end. Intentional looseness of fit at the joint enables further angular adjustment. Thus, a combination of chambers with original and severed ends, having a basic 6 degree end angle and 3 degree of looseness, can form a chamber string where the alignment angles between adjacent chamber axes range from minus 3 to plus 9 degrees. Such leaching chamber strings may be installed in practically level trenches which follow the contour of a hillside.

13 Claims, 2 Drawing Sheets

LEACHING CHAMBER WITH ANGLED END

TECHNICAL FIELD

The present invention relates to devices for dispersing and gathering liquids in soil, more particularly, to arch shaped plastic leaching chambers for use in dispersing sewage and storm waters.

BACKGROUND

In the last decade, molded plastic leaching chambers (also referred to as leaching conduits), sold under the registered U.S. trademark "Infiltrator", have met substantial commercial success. Examples of such type of chambers are shown in U.S. Pat. No. 4,759,661 to May and Nichols; and, in U.S. Pats. No. 5,017,041, No. 5,156,488 and 5,336,017 all to Nichols, all of which patents have an inventor and assignee in common herewith.

Generally, the commercial Infiltrator brand chambers and certain competitor products are arch shaped, have open bottoms, sloped perforated sides, and peak and valley corrugations running along the arch shape. Liquid introduced into the chamber disperses in the soil by passing through the open bottom and through the perforated sidewalls.

For economy of manufacture and distribution, typical chambers are identical, and nest readily for shipment. Chambers have opposing open ends adapted to enable one chamber to mate with other like chambers. Ends providing shiplap chamber joints strengthened by legs, tabs or other interlocks have been favored.

Typically, the molded chambers are placed end-to-end as an essentially straight string of units in a trench. Liquid flows through the chambers, from one to the next, by gravity. Thus, it is important that the units of a string of chambers will be placed in the earth so they have at most a very slight slope relative to the plane of the earth, from the first to the last, i.e., they must be "practially level". Thus, problems are presented when installations must be made on sloped land, such as a hillside, where the trench ought to follow a level contour line of the hill.

In the older designs of leaching chambers, for example in the type using spaced apart cast concrete galleries, the separate units can be put at angles to one another, and the non-parallel outlet and inlets of the galleries are connected by short lengths of pipe. The same approach can be used for the molded chambers. The trench in the soil is made in a jagged-curve, to follow the contour of the hillside and be practically level. Single chambers or short strings of chambers are fitted with end plates and connected as described just above. The disadvantage with this involves the use of endplates and pipe, which raises material and labor cost. And, longer trenches are needed to obtain the desired leaching area, presenting a problem on small lots.

One alternative for installing prior art molded chambers is to dig the trench straight and practically level. However, this can contravene good leaching practice since the trench necessarily becomes deep, and chambers are not placed near the surface of the earth where there is desirable oxygen transfer. In certain areas of the country, bedrock and ledge will make deep trenches infeasible. Another alternative is to provide an arch shape angle-adapter, or connector, interposing it between unaligned chambers. But, chamber ends must connect structurally, to best resist vertical loads during use. An adapter introduces the weakness of an additional joint or weakening point. And, having a separate component requires system installers to carry additional inventory.

Despite the continuing need, a better solution to the problem is required.

SUMMARY

An object of the invention is to provide a means for connecting molded leaching chambers in a way which enables them to be constructed as a curved string of chambers when desired. A further object is to provide a molded leaching chamber with an adaptation that enables curved strings to be constructed, but at the same time minimizes the disadvantages that attend having a separate adapter or connector.

In accord with one aspect of the invention, a leaching chamber has an arch shape cross section and opposing ends shaped to mate with the ends of other chambers; and, the terminus of at least one end of the chamber is angled with respect to the chamber longitudinal axis, to enable a string of chambers to be connected along the path of an approximate curve.

In accord with another aspect of the invention, the end of the chamber has a terminus with a first angle, and the end of the chamber can be severed from the chamber to provide a terminus having a second angle. For example, the original terminus angle may be less than 90 degrees, and upon severing, the chamber may have a new terminus angle of 90 degrees. Thus, when mated in original condition, the chambers will follow a curve; when mated after the end has been altered, chambers will follow a straight line.

A preferred chamber has an indicant fin running across the arch shape, to delineate the point at which the end may be detached from the chamber to create the new terminus; and, the indicant fin provides strengthening to the new terminus. A preferred first terminus angle is about 6 degrees from square. Preferably, the joint formed by mating chambers has a significant looseness of fit. The looseness of fit provides play, and an additional plus or minus angling, e.g., 3 degrees, from the basic alignment angle. Thus, in a preferred embodiment, the invention chambers can form strings of chambers where the angles between the longitudinal axes of adjacent connected chambers range from 3 degrees negative to 9 degrees positive.

The foregoing and other objects, features and advantages of the invention will become more apparent from the following description of the best mode of the invention and accompanying drawings.

DESCRIPTION

The invention is described in terms of a gas-assisted injection molded high density polyethylene leaching chamber, generally in accord with the preferred chambers disclosed in the aforementioned patents to Nichols, as well as in U.S. Pat. No. 5,401,459 to James M. Nichols and Roy E. Moore, Jr., the disclosures of which are hereby incorporated by reference.

Figure 1:
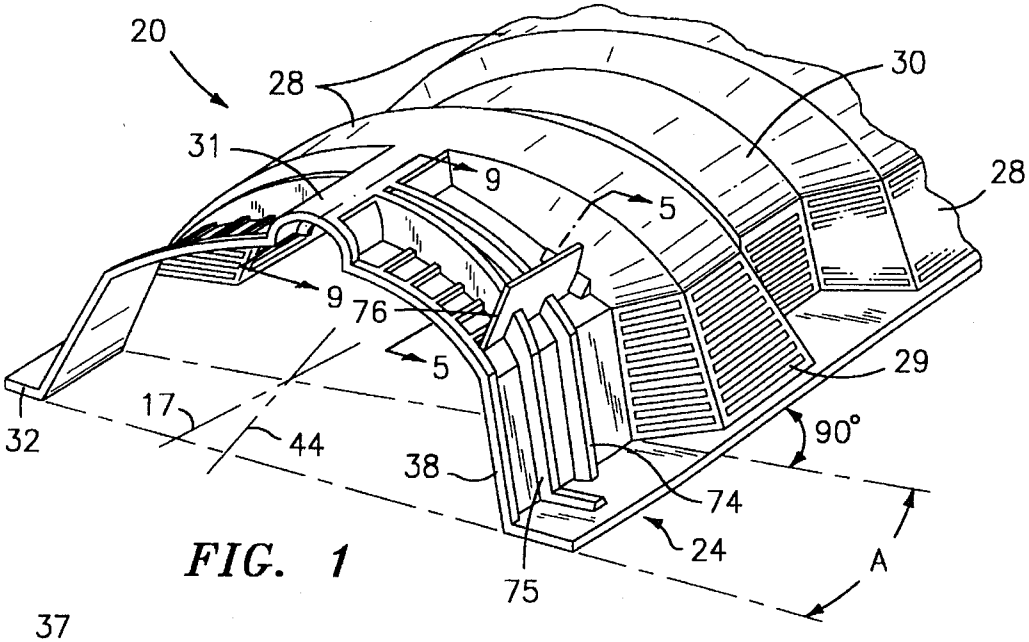
FIG. 1 is a perspective view of the angle end of a leaching chamber.
Figure 2:
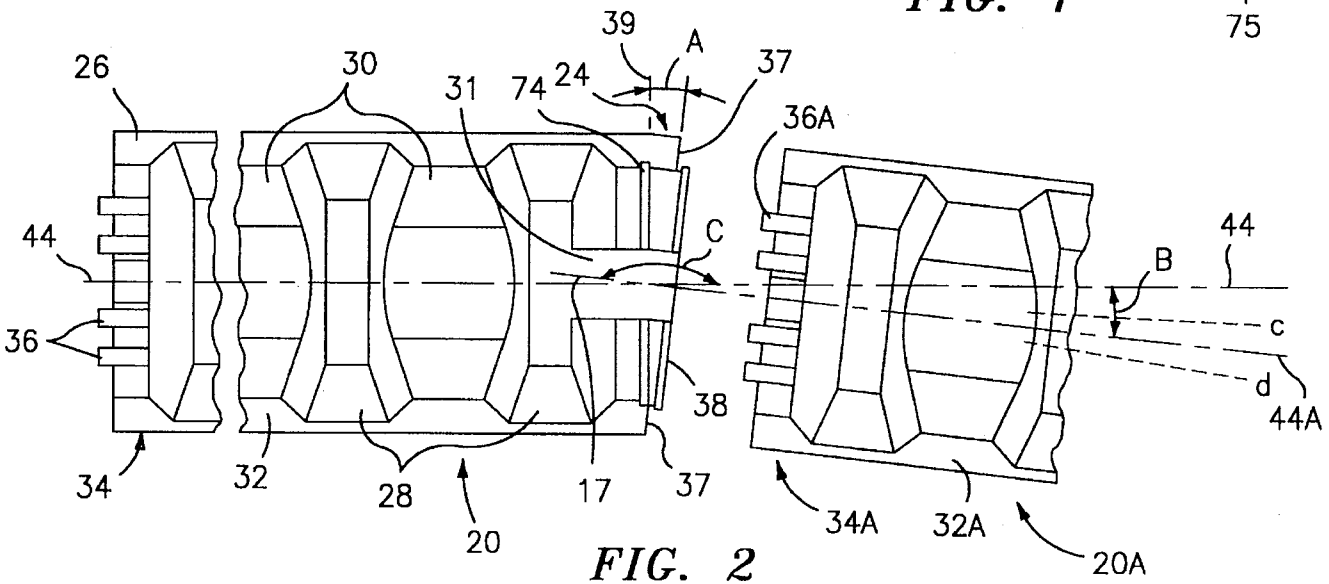
FIG. 2 shows in top view the chamber of FIG. 1, together with an opposing end portion of a second like chamber, positioned to mate with the angled opposing end of the first chamber.

FIG. 1 shows the angled end 24 and part of a typical chamber 20 having an arch shape cross section with corrugations comprised of alternating peaks 28 and valleys 30, running across the arch. The sidewalls of the chamber peaks and valleys have horizontal slotted perforations 29. FIG. 2. shows the same chamber in top view, as it is about to be mated with the square end 34A of a like chamber 20A. Some of the detail at the end 24 which is shown in FIG. 1 has been omitted for clarity of illustration in FIG. 2.

Figure 3:
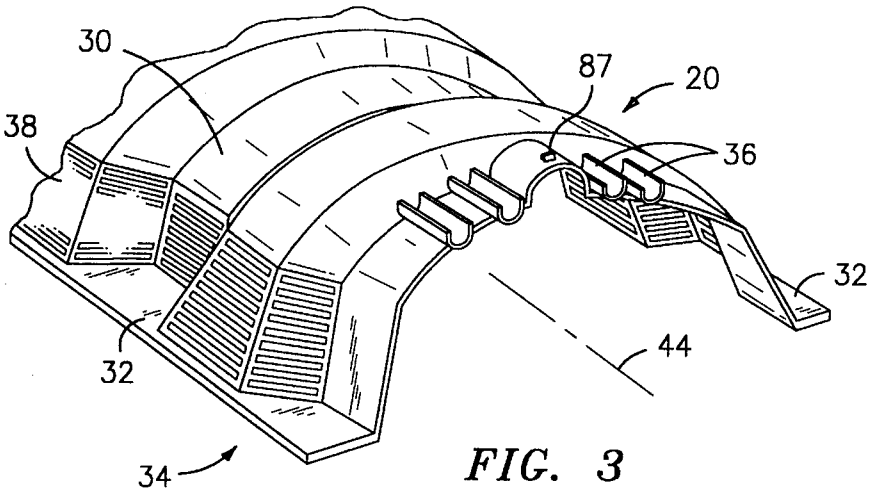
FIG. 3 is a perspective view of the right angle opposing end of the chamber of FIG. 1.

FIG. 3 shows in more detail the end 34 of the chamber 20, which is identical to the end 34A of chamber 20A. Suffixes are used for the part numbers of chamber 20A and for chambers in other figures, to identify features on different chambers or embodiments which correspond with each other.

Referring to FIG. 3, chamber 20 has a flanged base 32, comprised of two spaced apart flat surfaces. It resists penetration into the earth from downward forces during use. Integral with the end 34 is a terminus which is square, or perpendicular, to the chamber primary longitudinal axis 44. By "terminus" is meant that portion at the extremity of a chamber which is adapted to mate with a like chamber to form a joint. Extending from the end 34 as part of the terminus are cantilever legs 36, which engage the end of a mated chamber and transfer loads to and from it.

Referring to FIG. 1 and 2, the centerline 17 of angled end 24 of chamber 20 is angled with respect to the primary longitudinal axis 44 of the main body, or major portion, of the chamber. A reference to "angled end" or an analogous reference in this description is a reference to an end having a terminus which is at an angle other than a right angle, or an end which has a longitudinal axis which is not parallel to the primary longitudinal axis of the chamber. The longer sidewall of the end 24 follows a slight curve. The terminus 38 of the end is inclined at an acute angle A to the plane 39 perpendicular to the chamber centerline 44.

Figure 4:
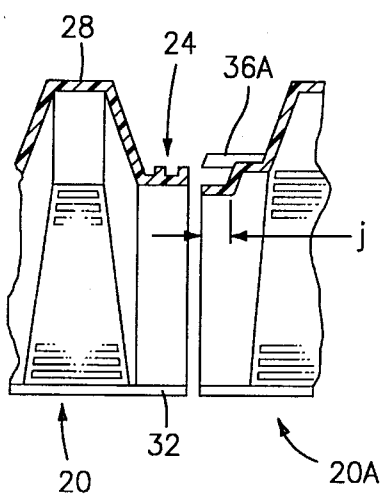
FIG. 4 is a off-centerline vertical cross section view of the angle end of the chambers shown in FIG. 2, showing how the left chamber will overlap the right one as they are mated.

The arch shape at the terminus of end 24 is slightly larger than that of the opposing chamber end 34, 34A, as is typical in the prior art. So, when chamber 20 is mated with chamber 20A, the terminus of end 34A of chamber 20A will be overlapped by the terminus of end 24 of chamber 20, forming a shiplap joint which prevents soil from entering the interiors of the chambers. The off-centerline vertical cross section of FIG. 4 shows how the chambers 20, 20A mate, with a length of overlap j, and how the legs 36A capture the overlapping chamber end 24. The shiplap or overlap feature may be omitted in some chamber joint designs, e.g, where a permeable fabric or other structure is overlaid the joint. Similarly, where there is minimal load, the legs may be omitted. The invention will be useful with all variety of open-end chamber designs, including those where opposing ends are identical to each other.

Reffering again to FIG. 1, at the top of the chamber end 24 is subarch 31 which, when the chamber is fitted with a suitable endplate closure having a mating semi-circular opening, enables connection of a pipe bringing liquid to the chamber, as known in the prior art. A preferred endplate slips into and is fastened in the opening, as with screws or detents. Other endplate designs may be used. Of course the subarch may be eliminated, such as when liquid is delivered through the top of the chamber or lower on the endplate.

In FIG. 2 mating chamber 20A is shown lying at an angle to the primary centerline 44 of chamber 20, so it aligns with the centerline 17 of end 24, to thereby be positioned for joining to it. Thus, when mated, the primary centerline 44A of chamber 20A forms an an oblique angle C, less than 180 degrees, with the primary centerline 44 of chamber 20, as measured in the horizontal or base plane of the chambers. For convenience, chamber alignment is defined herein according to angle B, the alignment angle. See FIG. 2. Angle B is the reciprocal of the angle C, i.e., 180–C=B. (For emphasis of illustration, the angles A, B, etc., are exaggerated somewhat in the Figures.)

In the first instance, the basic alignment angle B between the chamber centerlines is equal to the angle A which the terminus makes with the plane perpendicular to the primary longitudinal axis. However, the fit between the mating arch shape joint ends of the two chambers is made such as to provide sufficient clearance or play, so that when the chambers are fully mated, chamber 20A can rotate or angle somewhat about its point of mating with chamber 20. Thus, the centerline 44A of chamber 20A may be made to lie anywhere between the lines c and d.

The plus and minus angle represented by lines c and d relative to the basic alignment angle B will be limited according to the amount of overlap length j designed into the joint and length of legs 36, since the chambers must still engage sufficiently along the arch of the joint to enable those features to still serve their purpose. Of course, there was imperfect tightness of the lapping joint formed between prior art chambers, due to design and manufacturing tolerances, with the flexibility of the plastic chamber material. As a result, in prior art chambers there is a slight but unintended capability for plus or minus angular adjustment. However, such adjustment is typically of the order of substantially less than one degree, and is not significant in the context of the present invention's designed significant plus or minus angular adjustment.

The terminus of chamber 20 has two features which facilitate the significant plus or minus adjustment of the invention. First, the base 32 of chamber 20 has small cutouts or notches 37 at the corners of its terminus end, as seen in FIG. 2. These enable the mating chamber to rotate in the plus or minus angle range. Otherwise the base flanges would interfere with each other. Alternately, one or both of the mating chamber bases may be stepped at the corners, so the corner of one chamber may overlap the adjacent corner of the mating chamber, to achieve the same result. When a chamber is severed to form a new terminus, as described below, the base flanges at the new terminus will likewise be provided similar base features, either by design or by the installer removing a portion of the new terminus base flange.

Figure 9:
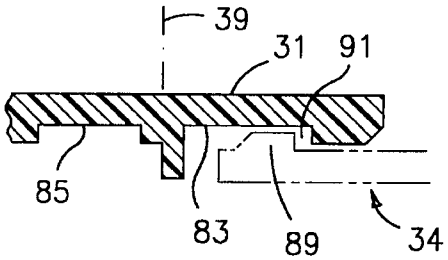
FIG. 9 shows a section through the subarch of the chamber of FIG. 1, showing interior pockets which engage with a nub on a mating chamber, to hold the chamber joint together.

Second, the typical prior art locking tab at the top of the subarch 31, which keeps the joint between chambers from separating, is changed. The change is necessary beacause, as one chamber is rotated within the plus or minus angle, the joint opens at the center point of the arch. FIG. 9 shows the changed features of the locking tab, through a centerline cross section of the end of the chamber 20, through the subarch 31. There is a pocket 83, into which fits nub 89 (See FIG. 3) on the subarch of the end 34 of the mating chamber, which is shown in phantom. The chambers are shown joined with zero plus or minus angling, and it is seen there is a clearance space 91. Thus, the space enables chambers to draw apart slightly, to permit taking advantage of the plus or minus angle feature. At the same time the locking system ensures they will not disengage from each other. When the angle end of chamber 20 is cut along plane 39, as described below, the pocket 85 becomes useful in substitution of the pocket 83.

Preferably, the the basic alignment angle B is about 6 degrees; and, the lines c and d will lie about 3 degrees, plus and minus, from the basic angle B. Thus, the total range of adjustment for such a chamber in its original fabricated condition will be 3–9 degrees.

Figure 5:
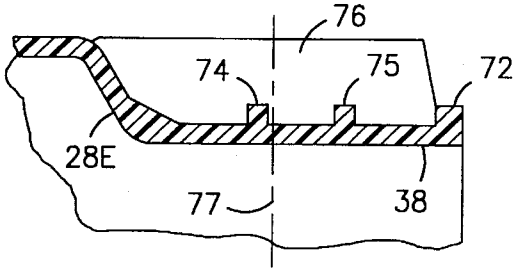
FIG. 5 is an off-centerline vertical cross section through a portion of the chamber shown in FIG. 1, to show fins, including an indicant fin, running along the arch shape perpendicular to a lengthwise rib.

FIG. 5 shows a fragment of the off-center vertical cross section, with reference to FIG. 1. There are two fins 74, 75 running along the curve of the arch. They intersect the lengthwise stiffening rib 76 which is positioned along the arch so it does not intefere with the legs 36 of a mating chamber. There is a further transverse stiffening fin 72 at the outer edge of terminus 38. As shown in FIG. 1, there are additional small lengthwise stiffening members on the exterior. There may be still other stiffening ribs running lengthwise and transversely on the chamber interior, as taught by the prior art. Preferably, the chamber is made by gas assisted injection molding. Thus, the fins may desirably be hollow and the ribs may be of stepped cross section with hollow bases, as described in Pat. No. 5,401,459.

Figure 6:
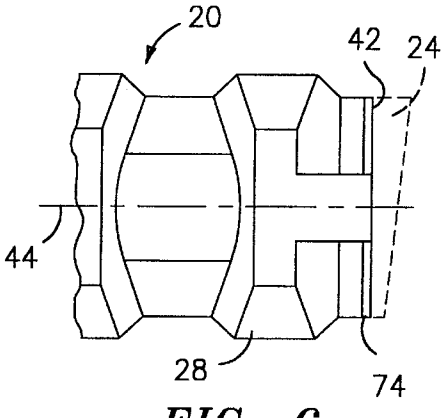
FIG. 6 is a top view of the first chamber shown in FIG. 2, to illustrate how the angle end may be removed at the indicant location.

The angle end of the chamber 20 is configured so that the angle end can be removed, to form a square end chamber. This is accomplished by cutting along the chamber outboard of, and parallel to, the inner fin 74, with a saw or other instrument, as illustrated by the top view in FIG. 6 and phantom line 77 in FIG. 5. The terminus of modified end 42 shown in FIG. 6 is substantially perpendicular to the centerline 44. The chamber is configured so that after the end 24 is detached, the resultant modified or new end is suitable for mating with another like chamber in the same way as was the original. It presents to a mating chamber, e.g. chamber 20A, a configuration having suitable shape and features to achieve, for example, good mating fit with the aforementioned plus or minus play, shiplapping all along, including at the subarch, and so forth. Of course, within the invention, the new terminus can have any different angle from the angle of the first end.

Thus, it will be appreciated that the fin 74 is an indicant. It demarcates where the angle end is removable. At the same time it functions as a strengthening fin at the outer edge, as does fin 72 in the original end, after the chamber is cut.

In a preferred embodiment, the chamber in original configuration has end design enabling the forming of a mating chamber pair, with chamber longitudinal axes angling within the range of 3–9 degrees. And, after alteration by cutting at the indicant, a chamber pair is formed with longitudinal axes angling within the range plus 3 degrees to minus 3 degrees from parallel or straight. Thus, the total angle range which the exemplary invention chamber enables at a joint with another chamber, when considering it in both its original condition and modified condition, is from minus 3 degrees to plus 9 degrees. Other basic end terminus angles and other degrees of plus or minus from the basic angle or modified end angle may be chosen, as desired.

Figure 7:
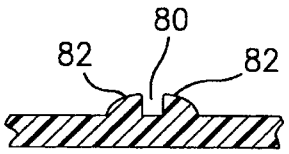
FIG. 7 is a cross section through a portion of the angle end of a chamber showing an alternative indicant design.

Thus, since the invention chambers can be converted as described, and one chamber can be used for both curved and straight strings, problems of inventory control with unconvertible units are avoided. The indicant, such as fin 74, provides the craftsman installing a chamber with a means for accurately and efficiently converting an angle end unit into a square end chamber. Other design of indicants, positive and negative relative to the chamber wall surface, may be used. For instance, two spaced apart fins 82 with a cutting groove 80 therebetween are shown in FIG. 7.

It will be understood that, before a chamber end is removed, an indicant will be in part longitudinally spaced away from the terminus. That is, it will be very close to, or at, the terminus on the chamber side where the end sidewall length is shortest, and further spaced apart from the terminus on the opposide side of the chamber. See FIG. 2. Obviously, it may also be entirely displaced from the terminus, toward the center of the chamber length.

The preferred embodiment comprises a chamber with an angled terminus at one end, severable to form a square end chamber. Within the scope of the invention the chamber may be made originally with a perpendicular terminus, severable to an angled terminus. Similarly, while in the preferred mode the chamber has one perpendicular end and one severable angled end, within the scope of invention both ends may be made angled or severable to angles.

Figure 8:
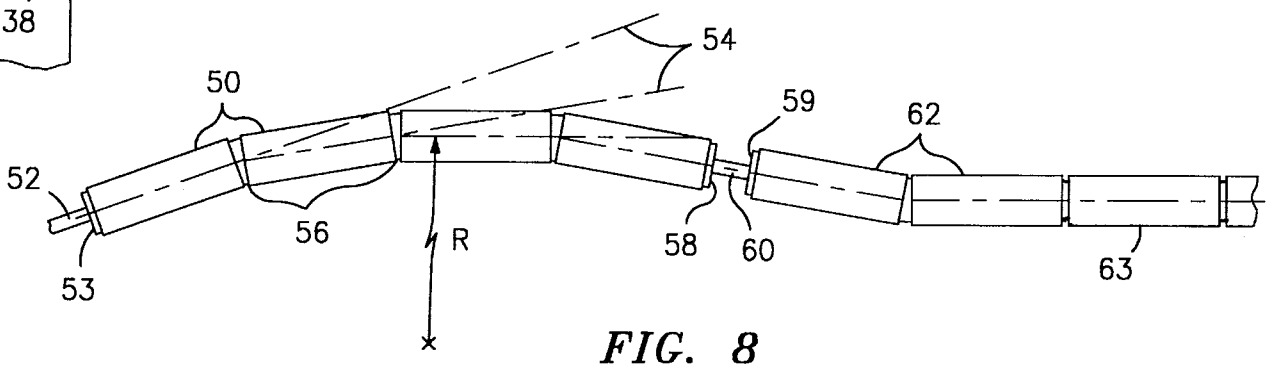
FIG. 8 is a top view of two strings of chambers connected by a pipe, where the strings have different combinations of roughly curving and straight alignments.

Flexible combinations of roughly curved and straight strings can be constructed. A string is minimally comprised of two chambers. FIG. 8 shows in top view two connected strings of chambers. At the left, a string subset of four 6 degree angle end chambers 50 is mated with a bias in the joint fit, so that successive axes 54 of the chambers are at 9 degrees to each other. Liquid to be dispersed enters through pipe 52, connected to an end plate 53 of the first chamber. For a typical commercial chamber of about 75 inch length, and an end configured for an angle connection capability of 3–9 degrees, the nominal radius R of curvature may be between 40 and 120 feet. To conveniently reverse the direction of the curve and to make an s-curve, the last chamber in the first string is closed by endplate 8. A short length of pipe 60 connects the plate 58 to the end plate 59 of a second string of chambers 62 at the right of the Figure. The 3+ chambers of the second string subset are laid in the trench with their angle ends facing oppositely to those of the first string. The first two chambers 62 follow a reverse curve arc of two chambers length. The second chamber 62 has its angle end cut away, whereby the next adjacent chamber 63 aligns with it and the string continues in a straight direction.

As will be appreciated, when a curve has been referred to herein, the term applies to a rough curve, given that the chambers are straight and not bendable. Similarly, when chambers are said to be aligned in a straight line, normal random variation from a perfectly straight line is expectable due to the play at the joint.

Within the generality of invention a chamber may have both ends angled the same or differently; the chambers may not have the strengthening corrugations which are preferred; and in a string of chambers, a mating chamber connected to an invention chamber need not be totally identical to it, so long as the mating chamber has a suitable end for joining. In fact, it is within contemplation that invention chambers will be used with prior art chambers having both ends square. Although only the preferred embodiment with some alternatives have been described, it will be understood that further changes in form and detail may be made without departing from the spirit and scope of the claimed invention.

We claim:

1. In a chamber, for dispersing or gathering liquids within soil, of the type having an arch shape cross section, wherein the base of the chamber corresponds with the base of the arch; the chamber having opposing first and second ends spaced apart along a primary longitudinal axis, the ends having terminuses shaped to enable mating of the chamber with other chambers to form a string of chambers; the improvement comprising: a first end of the chamber having a first terminus angled with respect to the chamber longitudinal axis, the first terminus enabling a similar chamber to be mated thereto, to provide a basic axial alignment angle greater than zero between the mated chambers; wherein, the improvement enables a string of like chambers to be connected to follow an approximate curve.

2. The chamber of claim 1 wherein the fit of the joint between mated like chambers has looseness sufficient to provide significant positive and negative angles of adjustment about the basic axial alignment angle between mated chambers.

3. The chamber of claim 2 wherein the positive and negative angle of adjustment are each about 3 degrees.

4. The chamber of claim 1 wherein the first end having the angled terminus is severable from the chamber, to form on the chamber a new terminus having an angle different from the angle of the original terminus, the new terminus adapted to mate with another chamber in the same manner as the terminus of the first end.

5. The chamber of claim 1 wherein the opposing ends are shaped for shiplap mating with like chambers.

6. The chamber of claim 1 having corrugations comprised of a multiplicity of alternating peaks and valleys running across the arch shape.

7. In a chamber, for dispersing or gathering liquids within soil, of the type having an arch shape cross section, wherein the base of the chamber corresponds with the base of the arch; the chamber having opposing first and second ends spaced apart along a longitudinal axis, the ends having terminuses shaped to enable mating of the chamber with other similar chambers to form a string of chambers; the improvement comprising: the first end having a terminus with a first terminus angle with respect to the longitudinal axis, to enable two like chambers to be connected so the axes of the two chambers form a first basic axial alignment angle; and, an indicant running along the arch shape, transverse to said longitudinal axis and at least partially spaced away from the terminus, to delineate a point where a portion of the first end is severable; wherein severing of the chamber along said indicant forms a chamber with a new terminus having a new angle transverse to the longitudinal axis, said new terminus angle different from said first angle; the new terminus adapted to mate with another chamber in the same manner as the terminus of the first end.

8. The chamber of claim 7 wherein the first terminus angle is less than 90 degrees and the new terminus angle is 90 degrees, so when the chamber end is severed, the new terminus enabling connecting of like chambers to form a straight string of chambers.

9. The chamber of claim 7 wherein the first terminus angle is 90 degrees and the new terminus angle is less than 90 degrees, so when the chamber end is severed, the new terminus enables connection of like chambers to form a curved string of chambers.

10. The chamber of claim 7 wherein a portion of the indicant is configured to serve as a strengthening fin running along the arch curve at the chamber new terminus, when the first end has been severed from the chamber at the indicant location.

11. A multiplicity of leaching chambers joined together to form a string, for dispersing or gathering liquids within soil, each chamber having an arch shape cross section open end, wherein the base of each chamber corresponds with the base of the arch; each chamber having opposing first and second ends spaced apart along a longitudinal axis, the ends shaped for mating of the chamber with another like chamber in the string; the multiplicity comprised of at least one each first configuration chamber and second configuration chamber;

the first configuration chamber having an end with a terminus angled with respect to perpendicular to the chamber longitudinal axis; the chamber forming an angled joint with the adjacent chamber of the string connected to the terminus;

the second configuration chamber having a terminus which is perpendicular to the longitudinal axis of the chamber, the chamber aligned essentially parallel with the adjacent chamber connected at the terminus;

wherein, the string follows an irregular path.

12. The multiplicity of chambers of claim 11 wherein the first configuration chamber has an indicant running along the arch shape, perpendicular to the longitudinal axis, and at least partially spaced away from the angled terminus, to delineate a point where a portion of the end having the angled terminus is severable from the chamber to form a chamber with a perpendicular end.

13. The multiplicity of chambers of claim 11 wherein the second configuration chamber is a first configuration chamber having had its angled terminus end severed.

* * * * *